US006982528B2

(12) United States Patent
Cottongim et al.

(10) Patent No.: US 6,982,528 B2
(45) Date of Patent: Jan. 3, 2006

(54) THERMAL PROTECTION FOR LAMP BALLASTS

(75) Inventors: David E. Cottongim, Sellersville, PA (US); Jecko Arakkal, Emmaus, PA (US); Venkatesh Chitta, Center Valley, PA (US); Mark S. Taipale, Harleysville, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 47 days.

(21) Appl. No.: 10/706,677

(22) Filed: Nov. 12, 2003

(65) Prior Publication Data

US 2005/0099142 A1 May 12, 2005

(51) Int. Cl.
*G05F 1/00* (2006.01)
*H01H 5/04* (2006.01)

(52) U.S. Cl. ..... 315/309; 315/307; 315/291; 315/118; 361/106; 361/103

(58) Field of Classification Search ..... 315/309, 315/307, 291, 118, 117, 112; 361/106, 103, 361/37, 35
See application file for complete search history.

(56) References Cited

U.S. PATENT DOCUMENTS

| | | | | | |
|---|---|---|---|---|---|
| 3,488,573 | A | | 1/1970 | Cavigelli et al. | 321/1.5 |
| 3,673,538 | A | * | 6/1972 | Faxon | 338/25 |
| 4,064,448 | A | | 12/1977 | Eatock | 323/22 |
| 4,467,386 | A | | 8/1984 | Wasson | 361/106 |
| 4,580,088 | A | | 4/1986 | Bloomer | 323/238 |
| 4,675,777 | A | | 6/1987 | Watrous | 361/106 |
| 4,800,974 | A | | 1/1989 | Wand et al. | 180/79.1 |
| 5,079,409 | A | * | 1/1992 | Takada et al. | 219/497 |
| 5,083,065 | A | * | 1/1992 | Sakata et al. | 315/307 |
| 5,869,969 | A | | 2/1999 | Cividino et al. | 324/431 |
| 6,198,234 | B1 | | 3/2001 | Henry | 315/291 |
| 6,452,344 | B1 | | 9/2002 | MacAdam et al. | 315/307 |
| 6,621,239 | B1 | | 9/2003 | Belliveau | 315/312 |
| 2002/0158861 | A1 | * | 10/2002 | Maksimovic et al. | 345/211 |
| 2002/0171985 | A1 | * | 11/2002 | Duffy et al. | 361/90 |
| 2003/0031037 | A1 | | 2/2003 | Piaskowski | 363/125 |

FOREIGN PATENT DOCUMENTS

| | | |
|---|---|---|
| DE | 195 36 142 A1 | 3/1997 |
| DE | 198 05 801 A1 | 8/1999 |
| DE | 100 13 041 A1 | 9/2001 |

* cited by examiner

*Primary Examiner*—Tuyet Thi Vo
(74) *Attorney, Agent, or Firm*—Woodcock Washburn LLP

(57) ABSTRACT

The output current of a ballast is dynamically limited when an over-temperature condition is detected in the ballast according to one of (i) a step function or (ii) a combination of step and continuous functions, so as to reduce the temperature of the ballast while continuing to operate it.

47 Claims, 9 Drawing Sheets

PRIOR ART
NON-DIMMING BALLAST

Prior Art
Dimming Ballast

THERMAL PROTECTION FOR LAMP BALLASTS

FIELD OF THE INVENTION

This invention relates to thermal protection for lamp ballasts. Specifically, this invention relates to a ballast having active thermal management and protection circuitry that allows the ballast to safely operate when a ballast over-temperature condition has been detected, allowing the ballast to safely continue to provide power to the lamp.

BACKGROUND OF THE INVENTION

Lamp ballasts are devices that convert standard line voltage and frequency to a voltage and frequency suitable for a specific lamp type. Usually, ballasts are one component of a lighting fixture that receives one or more fluorescent lamps. The lighting fixture may have more than one ballast.

Ballasts are generally designed to operate within a specified operating temperature. The maximum operating temperature of the ballast can be exceeded as the result of a number of factors, including improper matching of the ballast to the lamp(s), improper heat sinking, and inadequate ventilation of the lighting fixture. If an over-temperature condition is not remedied, then the ballast and/or lamp(s) may be damaged or destroyed.

Some prior art ballasts have circuitry that shuts down the ballast upon detecting an over-temperature condition. This is typically done by means of a thermal cut-out switch that senses the ballast temperature. When the switch detects an over-temperature condition, it shuts down the ballast by removing its supply voltage. If a normal ballast temperature is subsequently achieved, the switch may restore the supply voltage to the ballast. The result is lamp flickering and/or a prolonged loss of lighting. The flickering and loss of lighting can be annoying. In addition, the cause may not be apparent and might be mistaken for malfunctions in other electrical systems, such as the lighting control switches, circuit breakers, or even the wiring.

SUMMARY OF THE INVENTION

A lamp ballast has temperature sensing circuitry and control circuitry responsive to the temperature sensor that limits the output current provided by the ballast when an over-temperature condition has been detected. The control circuitry actively adjusts the output current as long as the over-temperature condition is detected so as to attempt to restore an acceptable operating temperature while continuing to operate the ballast (i.e., without shutting down the ballast). The output current is maintained at a reduced level until the sensed temperature returns to the acceptable temperature.

Various methods for adjusting the output current are disclosed. In one embodiment, the output current is linearly adjusted during an over-temperature condition. In another embodiment, the output current is adjusted in a step function during an over-temperature condition. In yet other embodiments, both linear and step function adjustments to output current are employed in differing combinations. In principle, the linear function may be replaced with any continuous decreasing function including linear and non-linear functions. Gradual, linear adjustment of the output current tends to provide a relatively imperceptible change in lighting intensity to a casual observer, whereas a stepwise adjustment may be used to create an obvious change so as to alert persons that a problem has been encountered and/or corrected.

The invention has particular application to (but is not limited to) dimming ballasts of the type that are responsive to a dimming control to dim fluorescent lamps connected to the ballast. Typically, adjustment of the dimming control alters the output current delivered by the ballast. This is carried out by altering the duty cycle, frequency or pulse width of switching signals delivered to a one or more switching transistors in the output circuit of the ballast. These switching transistors may also be referred to as output switches. An output switch is a switch, such as a transistor, whose duty cycle and/or switching frequency is varied to control the output current of the ballast. A tank in the ballast's output circuit receives the output of the switches to provide a generally sinusoidal (AC) output voltage and current to the lamp(s). The duty cycle, frequency or pulse width is controlled by a control circuit that is responsive to the output of a phase to DC converter that receives a phase controlled AC dimming signal provided by the dimming control. The output of the phase to DC converter is a DC signal having a magnitude that varies in accordance with a duty cycle value of the dimming signal. Usually, a pair of voltage clamps (high and low end clamps) is disposed in the phase to DC converter for the purpose of establishing high end and low end intensity levels. The low end clamp sets the minimum output current level of the ballast, while the high end clamp sets its maximum output current level.

According to one embodiment of the invention, a ballast temperature sensor is coupled to a foldback protection circuit that dynamically adjusts the high end clamping voltage in accordance with the sensed ballast temperature when the sensed ballast temperature exceeds a threshold. The amount by which the high end clamping voltage is adjusted depends upon the difference between the sensed ballast temperature and the threshold. According to another embodiment, the high and low end clamps need not be employed to implement the invention. Instead, the foldback protection circuit may communicate with a multiplier, that in turn communicates with the control circuit. In this embodiment, the control circuit is responsive to the output of the multiplier to adjust the duty cycle, pulse width or frequency of the switching signal.

The invention may also be employed in connection with a non-dimming ballast in accordance with the foregoing. Particularly, a ballast temperature sensor and foldback protection are provided as above described, and the foldback protection circuit communicates with the control circuit to alter the duty cycle, pulse width or frequency of the one or more switching signals when the ballast temperature exceeds the threshold.

In each of the embodiments, a temperature cutoff switch may also be employed to remove the supply voltage to shut down the ballast completely (as in the prior art) if the ballast temperature exceeds a maximum temperature threshold.

Other features of the invention will be evident from the following detailed description of the preferred embodiments.

DETAILED DESCRIPTION OF THE PREFERRED EMBODIMENTS

Figure 1:
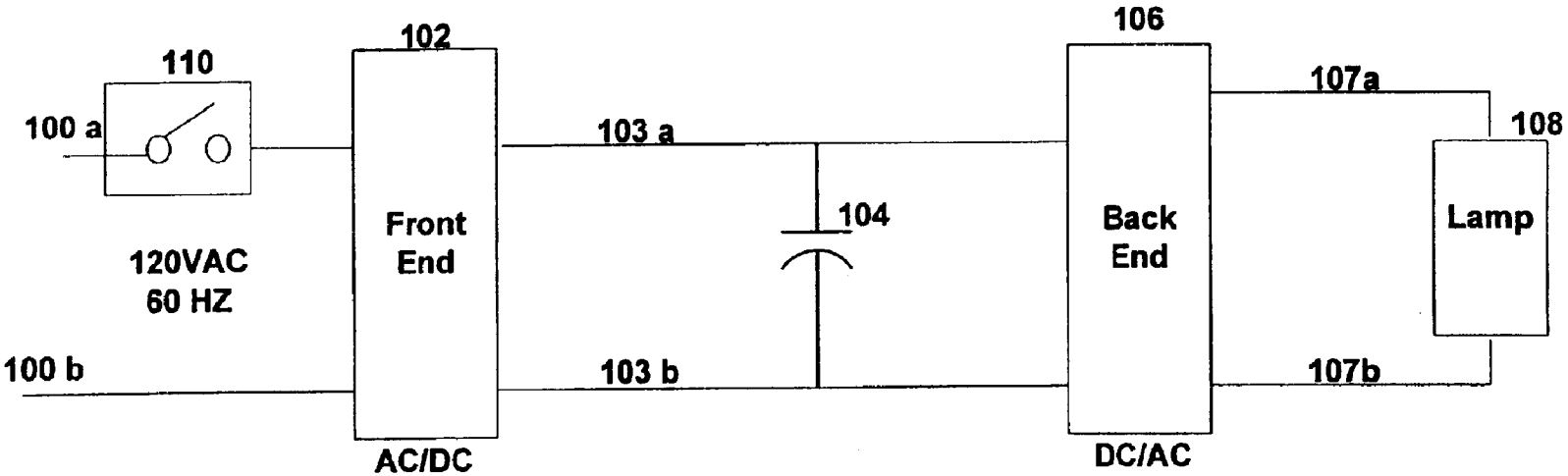
FIG. 1 is a functional block diagram of a prior art non-dimming ballast.
Figure 2:
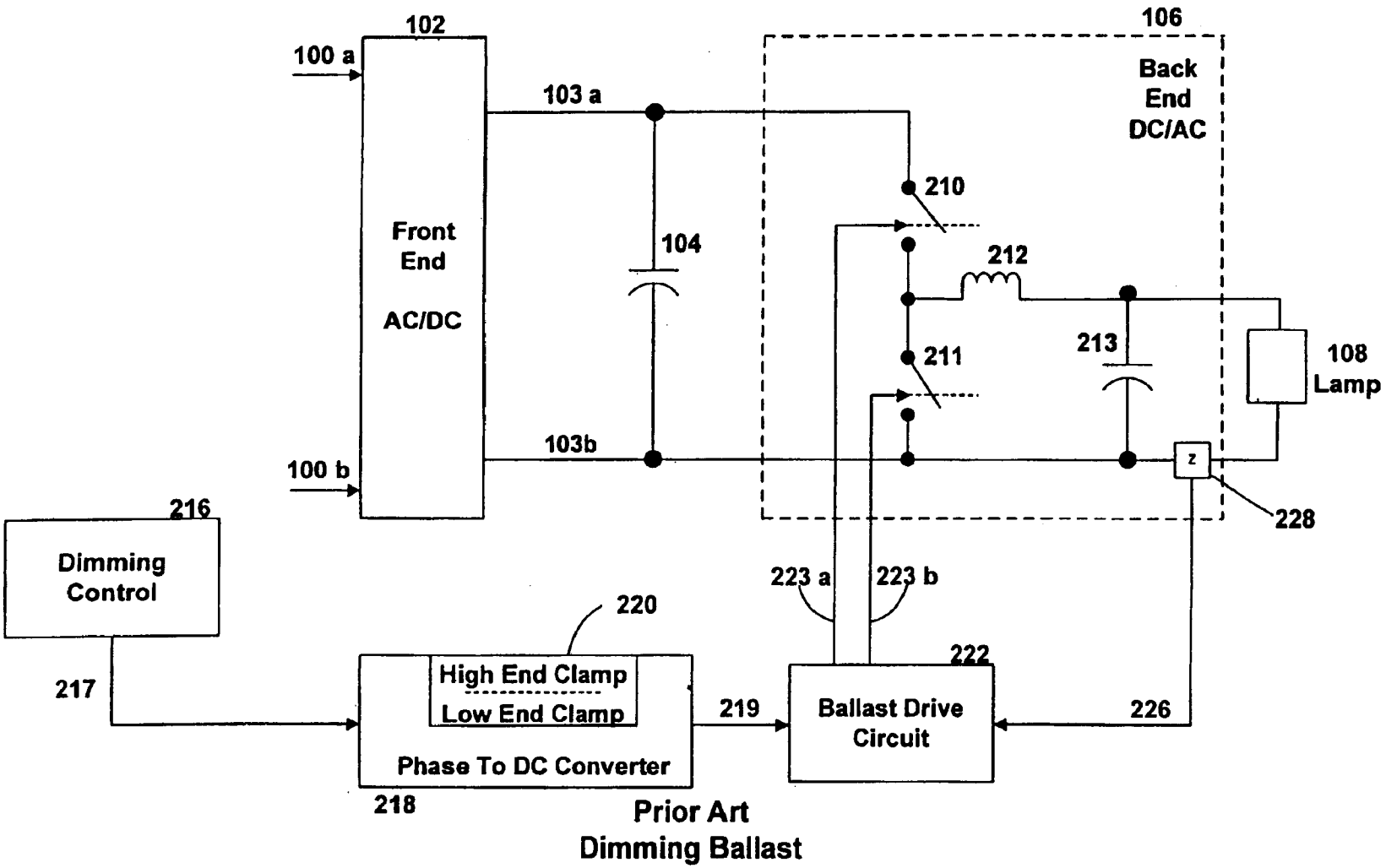
FIG. 2 is a functional block diagram of a prior art dimming ballast.

Turning now to the drawings, wherein like numerals represent like elements there is shown in FIGS. 1 and 2 functional block diagrams of typical prior art non-dimming and dimming ballasts, respectively. Referring to FIG. 1, a typical non-dimming ballast includes a front end AC to DC converter 102 that converts applied line voltage 100*a, b*, typically 120 volts AC, 60 Hz, to a higher voltage, typically 400 to 500 volts DC. Capacitor 104 stabilizes the high voltage output on 103*a, b* of AC to DC converter 102. The high voltage across capacitor 104 is presented to aback end DC to AC converter 106, which typically produces a 100 to 400 Volt AC output at 45 KHz to 80 KHz at terminals 107*a, b* to drive the load 108, typically one or more florescent lamps. Typically, the ballast includes a thermal cut-out switch 110. Upon detecting an over-temperature condition, the thermal cutout switch 110 removes the supply voltage at 100*a* to shut down the ballast. The supply voltage is restored if the switch detects that the ballast returns to a normal or acceptable temperature.

Figure 4:
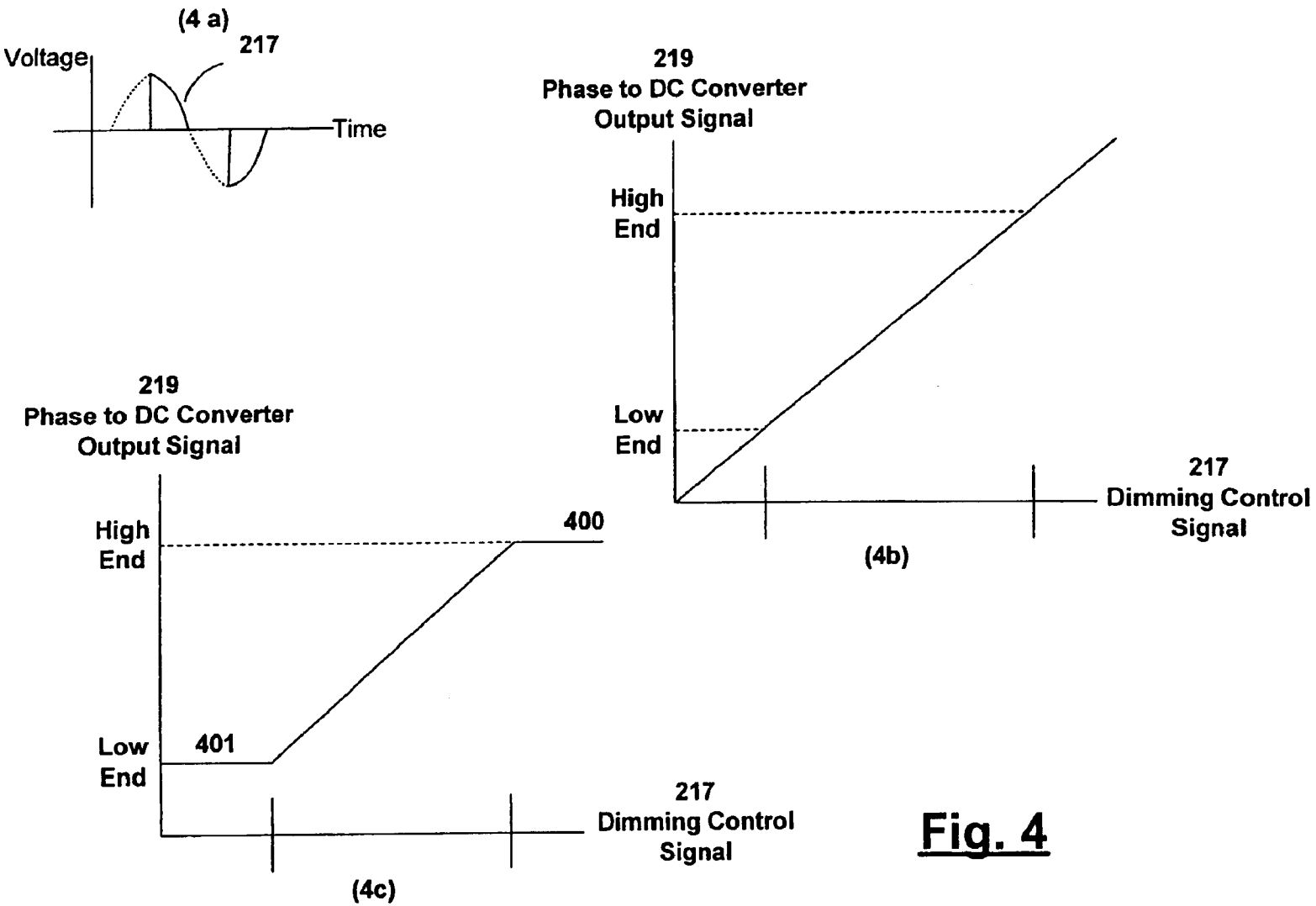
FIG. 4*a* graphically illustrates the phase controlled output of a typical dimming control.
FIG. 4*b* graphically illustrates the output of a typical phase to DC converter.
FIG. 4*c* graphically illustrates the effect of a high and low end clamp circuit on the output of a typical phase to DC converter.

The above description is applicable to FIG. 2, except that FIG. 2 shows additional details of the back end DC to AC converter 106, and includes circuitry 218, 220 and 222 that permits the ballast to respond to a dimming signal 217 from a dimming control 216. The, dimming control 216 may be any phase controlled dimming device and may be wall mountable. An example of a commercially available dimming ballast of the type of FIG. 2 is model number FDB-T554-120-2, available from Lutron Electronics, Co., Inc., Coopersburg, Pa, the assignee of the present invention. As is known, the dimming signal is a phase controlled AC dimming signal, of the type shown in FIG. 4*a*, such that the duty cycle of the dimming signal and hence the RMS voltage of the dimming signal varies with adjustment of the dimming actuator. Dimming signal 217 drives a phase to DC converter 218 that converts the phase controlled dimming signal 217 to a DC voltage signal 219 having a magnitude that varies in accordance with a duty cycle value of the dimming signal, as graphically shown in FIG. 4*b*. It will be seen that the signal 219 generally linearly tracks the dimming signal 217. However, clamping circuit 220 modifies this generally linear relationship as described hereinbelow.

The signal 219 stimulates ballast drive circuit 222 to generate at least one switching control signal 223*a, b*. Note that the switching control signals 223*a, b* shown in FIG. 2 are typical of those in the art that drive output switches in an inverter function (DC to AC) in the back-end converter 106. An output switch is a switch whose duty cycle and/or switching frequency is varied to control the output current of the ballast. The switching control signals control the opening and closing of output switches 210, 211 coupled to a tank circuit 212, 213. Although FIG. 2 depicts a pair of switching control signals, 223*a, b*, an equivalent function that uses only one switching signal may be used. A current sense device 228 provides an output (load) current feedback signal 226 to the ballast drive circuit 222. The duty cycle, pulse width or frequency of the switching control signals is varied in accordance with the level of the signal 219 (subject to clamping by the circuit 220), and the feedback signal 226, to determine the output voltage and current delivered by the ballast.

High and low end clamp circuit 220 in the phase to DC converter limits the output 219 of the phase to DC converter. The effect of the high and low end clamp circuit 220 on the phase to DC converter is graphically shown in the FIG. 4*c*. It will be seen that the high and low clamp circuit 220 clamps the upper and lower ends of the otherwise linear signal 219 at levels 400 and 401, respectively. Thus, the high and low end clamp circuitry 220 establishes minimum and maximum dimming levels.

A temperature cutoff switch 110 (FIG. 1) is also usually employed. All that has been described thus far is prior art.

Figure 3:
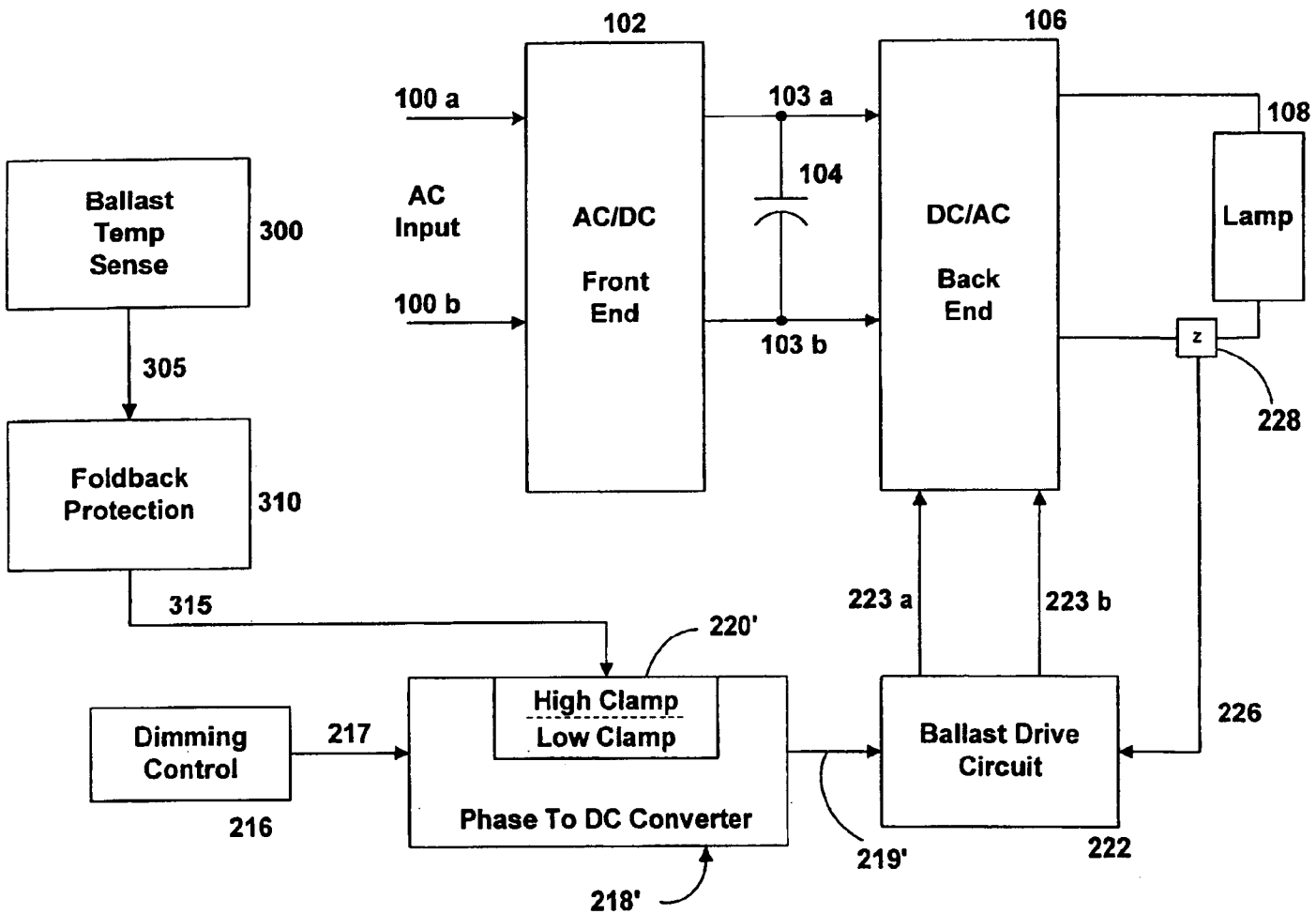
FIG. 3 is a functional block diagram of one embodiment of the present invention as employed in connection with a dimming ballast.

FIG. 3 is a block diagram of a dimming ballast employing the present invention. In particular, the dimming ballast of FIG. 2 is modified to include a ballast temperature sensing circuit 300 that provides a ballast temperature signal 305 to a foldback protection circuit 310. As described below, the foldback protection circuit 310 provides an appropriate adjustment signal 315 to the high and low end clamp circuit 220' to adjust the high cutoff level 400. Functionally, clamp circuit 220' is similar to clamp circuit 220 of FIG. 2, however, the clamp circuit 220' is further responsive to adjustment signal 315, which dynamically adjusts the high end clamp voltage (i.e. level 400).

The ballast temperature sensing circuit 300 may comprise one or more thermistors with a defined resistance to temperature coefficient characteristic, or another type of temperature sensing thermostat device or circuit. Foldback protection circuit 310 generates an adjustment signal 315 in response to comparison of temperature signal 305 to a threshold. The foldback protection circuit may provide either a linear output (using a linear response generator) or a step function output (using a step response generator), or a combination of both, if the comparison determines that an over-temperature condition exists. In principle, the exemplary linear function shown in FIG. 3 may be replaced with any continuous function including linear and non-linear functions. For the purpose of simplicity and clarity, the linear continuous function example will be used. But, it can be appreciated that other continuous functions may equivalently be used. Regardless of the exact function used, the high end clamp level 400 is reduced from its normal operating level when the foldback protection circuit 310 indicates that an over-temperature condition exists. Reducing the high end clamp level 400 adjusts the drive signal 219' to the ballast drive circuit 222 so as to alter the duty cycle, pulse width or frequency of the switching control signals 223*a, b* and hence reduce the output current provided by the ballast to load 108. Reducing output current should, under normal circumstances, reduce the ballast temperature. Any decrease in ballast temperature is reflected in signal 315, and the high end clamp level 400 is increased and/or restored to normal, accordingly.

FIGS. 5*a*–5*d* graphically illustrate various examples of adjusting the output current during an over-temperature condition. These examples are not exhaustive and other functions or combinations of functions may be employed.

Figure 5:
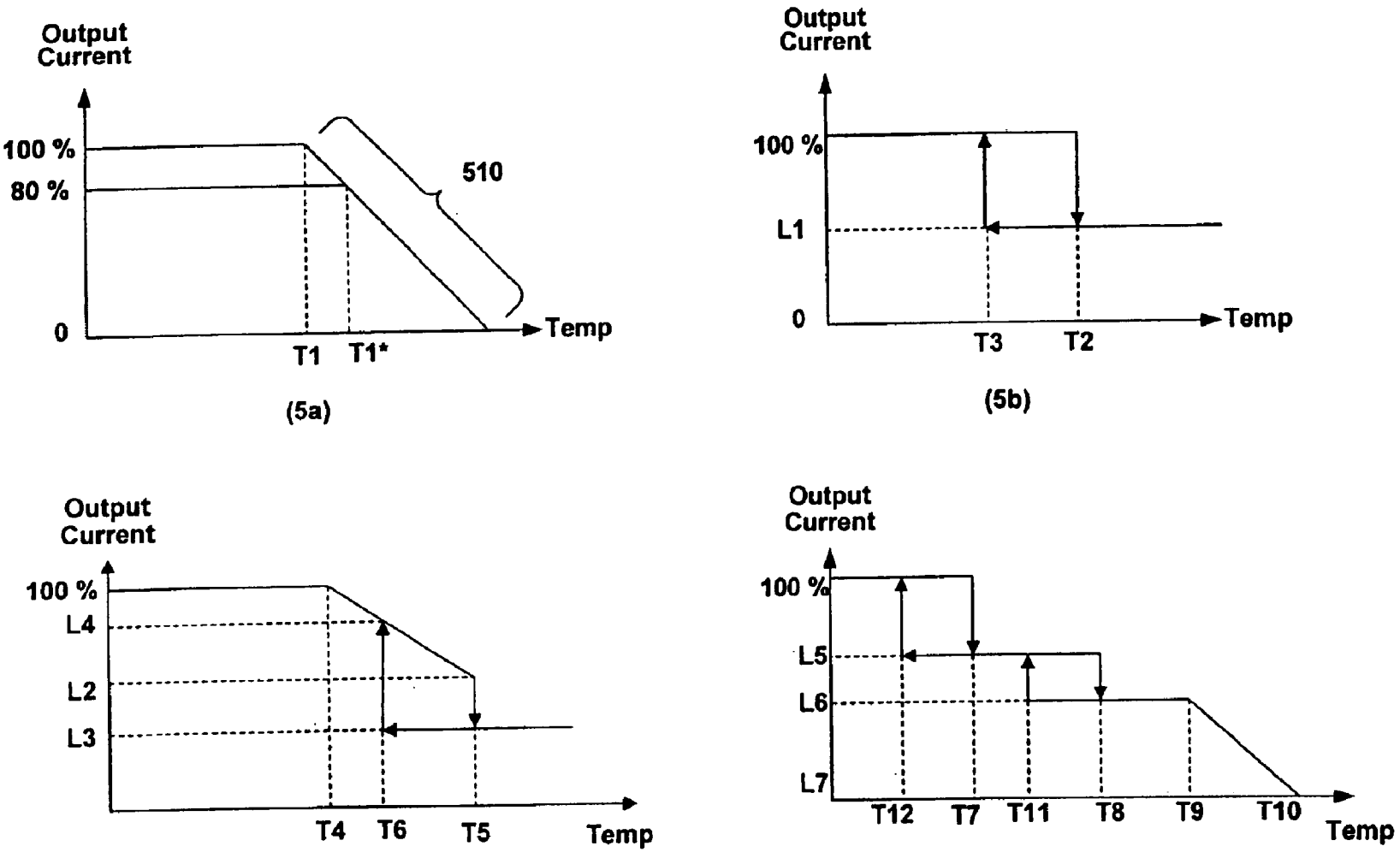
FIG. 5*a* graphically illustrates operation of an embodiment of the present invention to linearly adjust the ballast output current when the ballast temperature is greater than threshold T1.
FIG. 5*b* graphically illustrates operation of an embodiment of the present invention to reduce the ballast output current in a step function to a level L1 when the ballast temperature is greater than threshold T2, and to increase the output current in a step function to 100% when the ballast temperature decreases to a normal temperature T3.
FIG. 5*c* graphically illustrates operation of an embodiment of the present invention to adjust the ballast output current linearly between temperature thresholds T4 and T5, to reduce the ballast output current in a step function from level L2 to level L3 if temperature threshold T5 is reached or exceeded, and to increase the output current in a step function to level L4 when the ballast temperature decreases to threshold T6.
FIG. 5*d* graphically illustrates operation of an embodiment of the present invention to adjust the ballast output current in various steps for various thresholds, and to further adjust ballast output current linearly between levels L6 and L7 if the stepwise reductions in output current are not sufficient to restore the ballast temperature to normal.

In the example of FIG. 5*a*, output current is adjusted linearly when the ballast temperature exceeds threshold T1. If the ballast temperature exceeds T1, the foldback protection circuit 310 provides a limiting input to the high end clamp portion of the clamp circuit 220' so as to linearly reduce the high end clamp level 400, such that the output current may be reduced linearly from 100% to a preselected minimum. The temperature T1 may be preset by selecting the appropriate thresholds in the foldback protection circuit 310 as described in greater detail below. During the over-temperature condition, the output current can be dynamically adjusted in the linear region 510 until the ballast temperature stabilizes and is permitted to be restored to normal. Since fluorescent lamps are often operated in the saturation region of the lamp (where an incremental change in lamp current may not produce a corresponding change in light intensity), the linear adjustment of the output current may be such that the resulting change in intensity is relatively imperceptible to a casual observer. For example, a 40% reduction in output current (when the lamp is saturated) may produce only a 10% reduction in perceived intensity.

The embodiment of the invention of FIG. 3 limits the output current of the load to the linear region 510 even if the output current is less than the maximum (100%) value. For example, referring to FIG. 5*a*, the dimming control signal 217 may be set to operate the lamp load 108 at, for example, 80% of the maximum load current. If the temperature rises to above a temperature value T1, a linear limiting response is not activated until the temperature reaches a value of T1*. At that value, linear current limiting may occur which will limit the output current to the linear region 510. This allows the maximum (100%) linear limiting profile to be utilized even if the original setting of the lamp was less than 100% load current. As the current limiting action of the invention allows the temperature to fall, the lamp load current will once again return to the originally set 80% level as long as the dimmer control signal 217 is unchanged.

In the example of FIG. 5*b*, output current may be reduced in a step function when the ballast temperature exceeds threshold T2. If the ballast temperature exceeds T2, then the foldback protection circuit 310 provides a limiting input to the high end portion of the clamp 220' so as to step down the high end clamp level 400; this results in an immediate step down in supplied output current from 100% to level L1. Once the ballast temperature returns to an acceptable operating temperature T3, the foldback protection circuit 310 allows the output current to immediately return to 100%, again as a step function. Notice that recovery temperature T3 is lower than T2. Thus, the foldback protection circuit 310 exhibits hysteresis. The use of hysteresis helps to prevent oscillation about T2 when the ballast is recovering from a higher temperature. The abrupt changes in output current may result in obvious changes in light intensity so as to alert persons that a problem has been encountered and/or corrected.

In the example of FIG. 5*c*, both linear and step function adjustments in output current are employed. For ballast temperatures between T4 and T5, there is linear adjustment of the output current between 100% and level L2. However, if the ballast temperature exceeds T5, then there is an immediate step down in supplied output current from level L2 to level L3. If the ballast temperature returns to an acceptable operating temperature T6, the foldback protection circuit 310 allows the output current to return to level L4, again as a step function, and the output current is again dynamically adjusted in a linear manner. Notice that recovery temperature T6 is lower than T5. Thus, the foldback protection circuit 310 exhibits hysteresis, again preventing oscillation about T5. The linear adjustment of the output current between 100% and L2 may be such that the result change in lamp intensity is relatively imperceptible to a casual observer, whereas the abrupt changes in output current between L2 and L3 may be such that they result in obvious changes in light intensity so as to alert persons that a problem has been encountered and/or corrected.

In the example of FIG. 5*d*, a series of step functions is employed to adjust the output current between temperatures T7 and T8. Particularly, there is a step-wise decrease in output current from 100% to level L5 at T7 and another step-wise decrease in output current from level L5 to level L6 at T8. Upon a temperature decrease and recovery, there is a step-wise increase in output current from level L6 to level L5 at T11, and another step-wise increase in output current from level L5 to 100% at T12 (each step function thus employing hysteresis to prevent oscillation about T7 and T8). Between ballast temperatures of T9 and T10, however, linear adjustment of the output current, between levels L6 and L7, is employed. Once again, step and linear response generators (described below) in the foldback protection circuitry 310 of FIG. 3 allow the setting of thresholds for the various temperature settings. One or more of the step-wise adjustments in output current may result in obvious changes in light intensity, whereas the linear adjustment may be relatively imperceptible.

In each of the examples, a thermal cutout switch may be employed, as illustrated at 110 in FIG. 1, to remove the supply voltage and shut down the ballast if a substantial over-temperature condition is detected.

Figure 6:
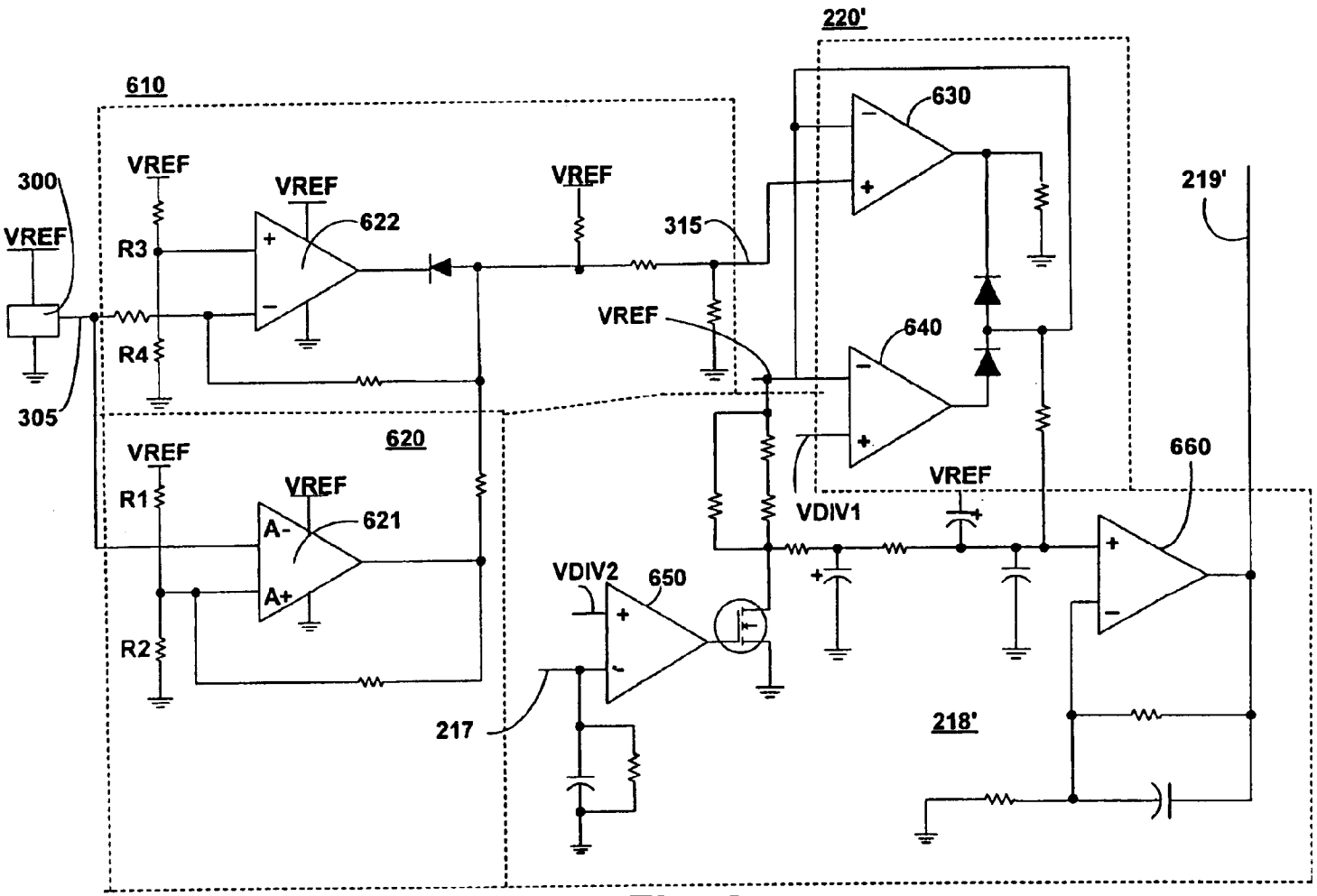
FIG. 6 illustrates one circuit level implementation for the embodiment of FIG. 3 that exhibits the output current characteristics of FIG 5*c*.

FIG. 6 illustrates one circuit level implementation of selected portions of the FIG. 3 embodiment. The foldback protection circuit 310 includes a linear response generator 610 and a step response generator 620. The adjustment signal 315 drives the output stage 660 of the phase to DC converter 218' via the high end clamp 630 of the clamp circuit 220'. A low end clamp 640 is also shown.

Temperature sensing circuit 300 may be an integrated circuit device that exhibits an increasing voltage output with increasing temperature. The temperature sensing circuit 300 feeds the linear response generator 610 and the step response generator 620. The step response generator 620 is in parallel with the linear response generator 610 and both act in a temperature dependent manner to produce the adjustment signal 315.

The temperature threshold of the linear response generator 610 is set by voltage divider R3, R4, and the temperature threshold of the step response generator 620 is set by voltage divider R1, R2. The hysteresis characteristic of the step response generator 620 is achieved by means of feedback, as is well known in the art.

The threshold of low end clamp 640 is set via a voltage divider labeled simply VDIV1. The phase controlled dimming signal 217 is provided to one input of a comparator 650. The other input of comparator 650 receives a voltage from a voltage divider labeled VDIV2. The output stage 660 of the phase to DC converter 218' provides the control signal 219'.

Those skilled in the art will appreciate that the temperature thresholds of the linear and step response generators 610, 620 may be set such that the foldback protection circuit 310 exhibits either a linear function followed by a step function (See FIG. 5*c*), of the reverse. Sequential step functions may be achieved by utilizing two step response generators 620 (See steps L5 and L6 of FIG. 5*d*). Likewise, sequential linear responses may be achieved by replacing the step response generator 620 with another linear response generator 610. If only a linear function (FIG. 5*a*) or only a step function (FIG. 5*b*) is desired, only the appropriate response generator is employed. The foldback protection circuit 310 may be designed to produce more than two types of functions, e.g., with the addition of another parallel stage. For example the function of FIG. 5*d* may be obtained with the introduction of another step response generator 620 to the foldback protection circuit, and by setting the proper temperature thresholds.

Figure 7:
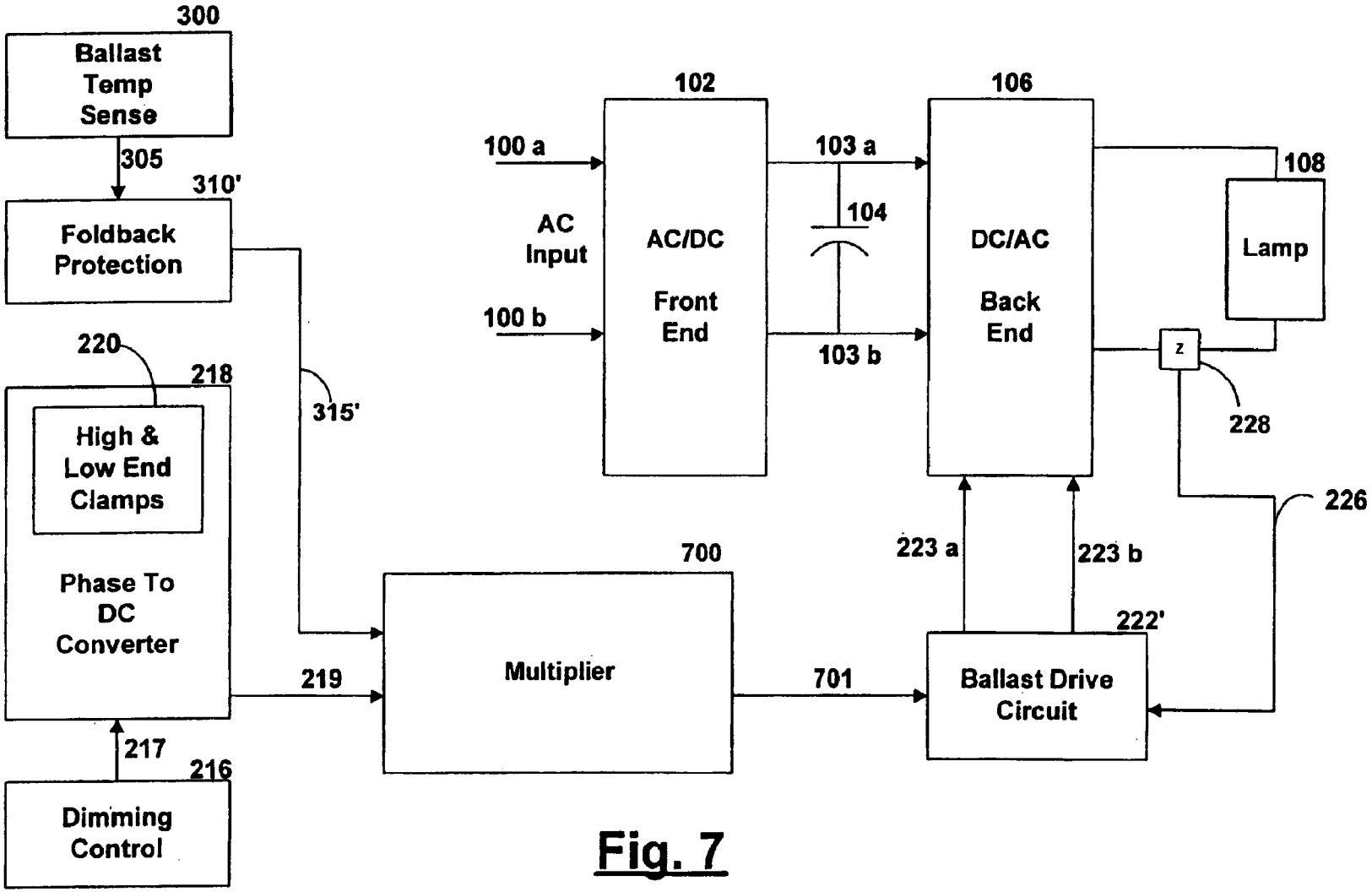
FIG. 7 is a functional block diagram of another embodiment of the present invention for use in connection with a dimming ballast.

FIG. 7 is a block diagram of a dimming ballast according to another embodiment of the invention. Again, the dimming ballast of FIG. 2 is modified to include a ballast temperature sensing circuit 300 that provides a ballast temperature signal 305 to a foldback protection circuit 310. The foldback protection circuit 310' produces, as before, an adjustment signal 315' to modify the response of the DC to AC back end 106 in an over-temperature condition. Nominally, the phase controlled dimming signal 217 from the dimming control 216, and the output of the high and low end clamps 220, act to produce the control signal 219 that is used, for example, in the dimming ballast of FIG. 2. However, in the configuration of FIG. 7, the control signal 219 and the adjustment signal 315' are combined via multiplier 700. The resulting product signal 701 is used to drive the ballast drive circuit 222' in conjunction with feedback signal 226. It should be noted that ballast drive circuit 222' performs the same function as the ballast drive circuit 222 of FIG. 3 except that ballast drive circuit 222' may have a differently scaled input as described hereinbelow.

As before, in normal operation, dimming control 216 acts to deliver a phase controlled dimming signal 217 to the phase to DC converter 218. The phase to DC converter 218 provides an input 219 to the multiplier 700. The other multiplier input is the adjustment signal 315'.

Under normal temperature conditions, the multiplier 700 is influenced only by the signal 219 because the adjustment signal 315' is scaled to represent a multiplier of 1.0. Functionally, adjustment signal 315' is similar to 315 of FIG. 3 except for the effect of scaling. Under over-temperature conditions, the foldback protection circuit 310' scales the adjustment signal 315' to represent a multiplier of less than 1.0. The product of the multiplication of the signal 219 and the adjustment signal 315' will therefore be less than 1.0 and will thus scale back the drive signal 701, thus decreasing the output current to load 108.

Figure 8:
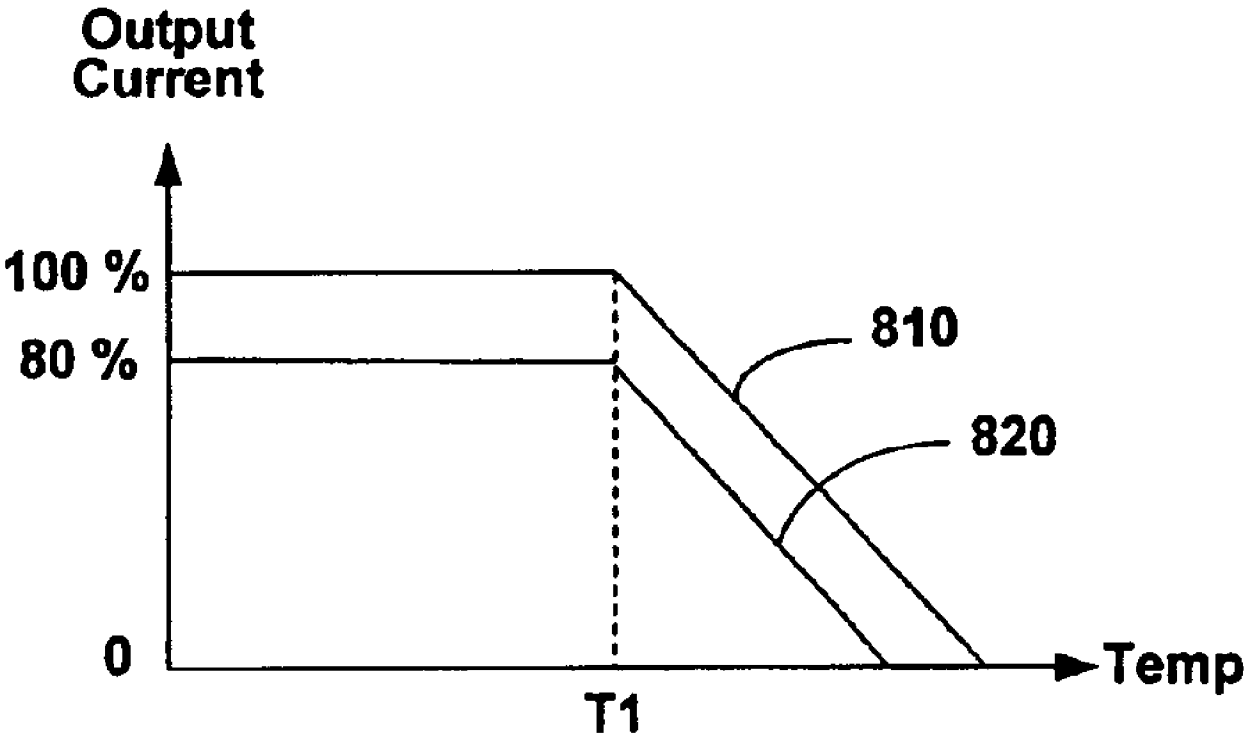
FIG. 8 is an output current versus temperature response for the embodiment of FIG. 7.

FIG. 8 illustrates the response of output current versus temperature for the embodiment of FIG. 7. As in the response shown in FIG. 5*a*, at 100% of load current, the current limiting function may be linearly decreasing beyond a temperature T1. However, in contrast to FIG. 5*a*, the response of the embodiment of FIG. 7 at lower initial current settings is more immediate. In the multiplier embodiment of FIG. 7, current limiting begins once the threshold temperature of T1 is reached. For example, the operating current of the lamp 108 may be set to be at a level lower than maximum, say at 80%, via dimmer control signal 217 which results in an input signal 219 to multiplier 700. Assuming that the temperature rises to a level of T1, the multiplier input signal 315' would immediately begin to decrease to a level below 1.0 thus producing a reduced output for the drive signal 701. Therefore, the 100% current limiting response profile 810 is different from the 80% current limiting response profile 820 beyond threshold temperature T1.

It can be appreciated by one of skill in the art that the multiplier 700 may be implemented as either an analog or a digital multiplier. Accordingly, the drive signals for the multiplier input would be correspondingly analog or digital in nature to accommodate the type of multiplier 700 utilized.

Figure 9:
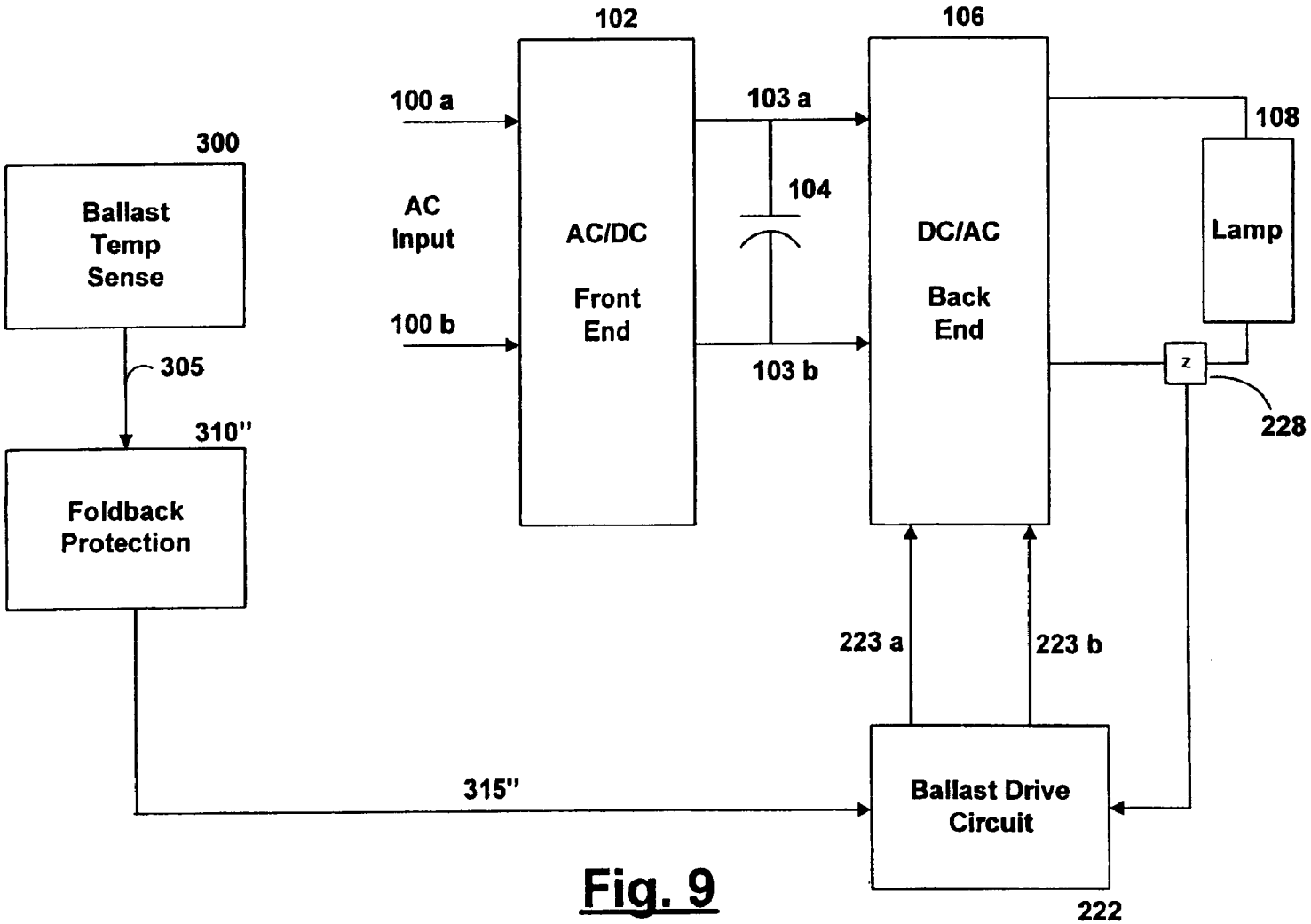
FIG. 9 is a functional block diagram of an embodiment of the present invention that may be employed with a non-dimming ballast.

FIG. 9 illustrates application of the invention to a non-dinning ballast, e.g., of the type of FIG. 2, which does not employ high end and low end clamp circuitry or a phase to DC converter. As before, there is provided a ballast temperature sensing circuit 300 that provides a ballast temperature signal 305 to a foldback protection circuit 310". The foldback protection circuit 310' provides an adjustment signal 315" to ballast drive circuit 222. Instead of adjusting the level of a high end clamp, the adjustment signal 315" is provided directly to ballast drive circuit 222. Otherwise the foregoing description of the function and operation of FIG. 3, and the examples of FIGS. 5*a* –5*d*, are applicable.

The circuitry described herein for implementing the invention is preferably packaged with, or encapsulated within, the ballast itself, although such circuitry could be separately packaged from, or remote from, the ballast.

The circuitry for implementing the invention can be integral with or packaged within, or external to, the ballast.

It will be apparent to those skilled in the art that various modifications and variations may be made in the apparatus and method of the present invention without departing from the spirit or scope of the invention. For example, although a linearly decreasing function is disclosed as one possible embodiment for implementation of current limiting, other continuously decreasing functions, even non-linear decreasing functions, may be used as a current limiting mechanism without departing from the spirit of the invention. Thus, it is intended that the present inventor encompass modifications and variations of this invention provided those modifications and variations come within the scope of the appended claims and equivalents thereof.

What is claimed is:

1. A circuit for controlling output current from a ballast to a lamp comprising:

a) a temperature sensing circuit thermally coupled to the ballast to provide a temperature signal having a magnitude indicative of ballast temperature, Tb, and b) control circuitry capable of causing the ballast to enter a current limiting mode when the magnitude of the temperature signal indicates that Tb has exceeded a predetermined maximum desired ballast temperature, T1;

wherein the control circuitry reduces the output current in response to the temperature signal according to one of (i) a step function or (ii) a combination of step and continuous functions, while continuing to operate the ballast.

2. The circuit of claim 1, wherein the continuous function is a linear function.

3. The circuit of claim 1 wherein reductions and increases in output current cause reductions and increases in illumination provided by the lamp, and wherein the reductions are abrupt and perceptible to a human.

4. The circuit of claim 1 wherein the control circuitry, when operating the ballast in the current limiting mode, is responsive to a determination that Tb is equal to or less than a threshold temperature T2 to increase the output current, wherein T2 is less than T1, such that the output current profile exhibits hysteresis in the current limited mode.

5. The circuit of claim 4 comprising circuitry that provides a first threshold signal having a magnitude indicative of T1, and at least another, second, threshold signal having a magnitude indicative of T2.

6. The circuit of claim 4 wherein the control circuitry increases the output current in a step function.

7. The circuit of claim 4 wherein the control circuitry both reduces and increases the output current in step functions.

8. The circuit of claim 1 wherein the current limiting mode has a first state that reduces the output current in a linear function and a second state, following the first state, that further reduces the output current in a step function.

9. The circuit of claim 8 wherein, the control circuitry causes the ballast to enter the first state of current limiting mode when the magnitude of the temperature signal indicates that Tb has exceeded T1 and to enter the second state when the magnitude of the temperature signal indicates that Tb has exceeded a temperature T2, that is greater than T1.

10. The circuit of claim 9 wherein, the control circuitry, when operating the ballast in the second state of the current limiting mode, is responsive to a determination that Tb has decreased to a temperature T3, that is between T1 and T2, to increase the output current in a step function.

11. The circuit of claim 1 wherein the current limiting mode has a first state that reduces the output current in successive step functions.

12. The circuit of claim 11 wherein the current limiting mode has a second state, following a last one of the step functions, that further reduces the output current in a linear function.

13. The circuit of claim 11 comprising circuitry that provides a first threshold signal indicative of the magnitude of T1 and a second threshold signal indicative of the magnitude of a temperature T2 that is greater than T1, wherein the control circuitry, when operating the ballast in the first state of the current limiting mode, is responsive to a determination that Tb has reached TI to decrease the output current in a first step function, and to a determination that Tb has reached T2 to further decrease the output current in a second step function.

14. The circuit of claim 13 wherein the circuitry provides a third threshold signal indicative of the magnitude of a temperature T3 that is less than T1 and a fourth threshold signal indicative of the magnitude of a temperature T4 that is between T2 and T1, and wherein the control circuitry, when operating the ballast in the first state of the current limiting mode, is responsive to a determination that Tb has decreased to T4 to increase the output current in a third step function, and to a determination that Tb has further decreased to T3 to further increase the output current in a fourth step function.

15. The circuit of claim 1 further comprising a temperature cutoff circuit for shutting down the ballast if Tb reaches or exceeds an unsafe maximum temperature that is greater than T1.

16. The circuit of claim 14 wherein the ballast is a dimming ballast responsive to a phase controlled AC dimming signal produced by a dimming control, and the control circuitry comprises:

a phase to DC converter that converts the dimming signal to a DC signal having a magnitude that varies in accordance with a duty cycle value of the dimming signal, and a drive circuit that generates at least one switching signal for driving at least one output switch of the ballast;

wherein the drive circuit is responsive to the DC signal and to a feedback signal indicative of the output current to alter the at least one switching signal.

17. The circuit of claim 15 wherein the ballast is a dimming ballast responsive to a phase controlled AC dimming signal produced by a dimming control, and the control circuitry comprises:

a phase to DC converter that converts the dimming signal to a DC signal having a magnitude that varies in accordance with a duty cycle value of the dimming signal, a multiplier circuit providing an output in accordance with the DC signal and a scaled difference between Tb and T1, and a drive circuit that generates at least one switching signal for driving at least one output switch of the ballast;

wherein the drive circuit is responsive to the output of the multiplier and to a feedback signal indicative of the output current, to alter the at least one switching signal.

18. The circuit of claim 1 wherein the control circuitry generates at least one switching signal for driving at least one output switch of the ballast, and is responsive to a difference between Tb and T1 to alter one of duty cycle, pulse width or frequency of the at least one switching signal.

19. The circuit of claim 18 wherein the control circuitry further comprises a clamp circuit that prevents the magnitude of the DC signal from exceeding a pre-selected upper level, and wherein the pre-selected upper level is adjusted in accordance with the difference between Tb and T1.

20. A ballast comprising:

a) an output circuit that provides output current to a load and having switching circuitry;

b) a reference generator providing reference information concerning a first threshold temperature, T1, for the ballast;

c) a temperature sensitive device to provide ballast operating temperature information, Tb;

d) comparison circuitry that provides a first signal having a magnitude indicative of a difference by which Tb exceeds T1; and e) control circuitry providing a drive signal to the switching circuitry, the control circuitry responsive to the signal provided by the comparison circuitry to adjust at least one of duty cycle, pulse width or frequency of the drive signal so as to alter the output current provided by the ballast according to one of (i) a step function or (ii) a combination of step and continuous functions, while continuing to operate the ballast, when the comparison circuitry indicates that Tb is greater than T1.

21. The ballast of claim 20 wherein the reference generator provides information concerning a second threshold temperature T2, less than T1, for the ballast, and wherein the comparison circuitry provides a second signal having a magnitude indicative of a difference by which Tb exceeds T2, and wherein the control circuitry is responsive to the first signal from the comparison circuitry to reduce the output current to a first current level in a step function at T1, and is responsive to the second signal from the comparison circuitry to increase the output current in a step function to a second current level greater than the first current level at T2.

22. The ballast of claim 20 wherein the load is a lamp and alterations in output current cause alterations in illumination provided by the lamp, and wherein the alterations are abrupt and perceptible to a human.

23. The ballast of claim 20 further comprising a temperature cutoff circuit for shutting down the ballast if Tb reaches or exceeds an unsafe maximum temperature that is greater than T1.

24. The circuit of claim 20 wherein the ballast is a dimming ballast responsive to a phase controlled AC dimming signal produced by a dimming control, and the control circuitry comprises:

a phase to DC converter that converts the dimming signal to a DC signal having a magnitude that varies in accordance with a duty cycle value of the dimming signal, a multiplier circuit providing an output in accordance with the DC signal and a scaled difference between Tb and T1, and a drive circuit that generates at least one switching signal for driving at least one output switch of the ballast;

wherein the drive circuit is responsive to the output of the multiplier, and to a feedback signal indicative of output current, to adjust the at least one switching-signal to the switching circuitry.

25. The ballast of claim 20 wherein the control circuitry is responsive to the signal from the comparison circuitry to reduce the output current linearly between T1 and a second threshold temperature T2 greater than T1, and to reduce the output current in a step function at T2.

26. The ballast of claim 25 wherein the control circuitry increases the output current in a step function at a third threshold temperature T3 that is between the threshold temperatures T1 and T2.

27. The ballast of claim 20 wherein the ballast is a dimming ballast responsive to a phase controlled AC dimming signal produced by a dimming control, and the control circuitry comprises:

a phase to DC converter that converts the dimming signal to a DC signal having a magnitude that varies in accordance with a duty cycle value of the dimming signal, and a drive circuit that generates at least one switching signal for driving at least one output switch of the ballast;

wherein the drive circuit is responsive to the DC signal and to a feedback signal indicative of the output current to adjust the at least one switching signal to the switching circuitry.

28. The ballast of claim 27 wherein the control circuitry further comprises a clamp circuit that prevents the magnitude of the DC signal from exceeding a pre-selected upper level, and wherein the pre-selected upper level is adjusted in accordance with the difference by which Tb exceeds T1.

29. A thermally protected ballast comprising:

(a) a front end AC-to-DC converter for receiving a supply voltage;

(b) a back end DC-to-AC converter coupled to the front end AC-to DC converter for providing output current to a load;

(c) a temperature sensitive device adapted to provide a signal indicative of a temperature of the ballast, Tb;

(d) a current limiting circuit providing an output responsive to Tb; and (e) a control circuit responsive to the output of the current limiting circuit, and driving the back end DC-to-AC converter in accordance with the output of the current limiting circuit;

wherein the current limiting circuit causes the control circuit to adjust the output current in response to a detected over-temperature condition, according to one of (i) a step function or (ii) a combination of step and linear functions, while continuing to operate the control circuit.

30. The ballast of claim 29 further comprising a temperature cutoff circuit for shutting down the ballast if the temperature of the ballast reaches or exceeds an unsafe maximum temperature.

31. The ballast of claim 29 wherein the control circuit reduces the output current linearly when Tb is between a first threshold temperature T1 and a second threshold temperature T2 that is greater than T1, and reduces the output current in a step function when Tb is equal to or greater than T2.

32. The ballast of claim 31 wherein, after Tb reaches T2, the control circuit increases the output current in a step function at a third threshold temperature T3 that is between T1 and T2.

33. A method of controlling a ballast comprising the steps of:

a) measuring ballast temperature, Tb;

b) comparing Tb to a first reference, T1;

c) providing an indication of difference between Tb and T1; and d) controlling output current provided by the ballast according to one of (i) a step function or (ii) a combination of step and continuous functions, while continuing to operate the ballast, in accordance with the result of step (c).

34. The method of claim 33 wherein step (d) comprises altering one of duty cycle, pulse width or frequency of at least one switching signal provided to at least one switch in an output circuit of the ballast in accordance with the difference.

35. The method of claim 33 further comprising shutting down the ballast if the ballast temperature reaches or exceeds an unsafe maximum temperature.

36. The method of claim 33 wherein the ballast is responsive to a phase controlled AC dimming signal produced by a dimming control and the output current is controlled by at least one output switch; and wherein step (d) comprises the steps of (1) scaling the indication of the difference between Tb and T1;

(2) converting the dimming signal to a DC signal having a magnitude that varies in accordance with a duty cycle value of the dimming signal;

(3) multiplying the DC signal and the scaled indication of the difference between Tb and T1 from step (1); and (4) controlling the at least one output switch in response to the result of step (3) and to a feedback signal indicative of the output current.

37. The method of claim 33 wherein controlling the output current causes reductions and increases in the illumination provided by a lamp connected to the ballast, and wherein the reductions are abrupt and perceptible to a human.

38. The method of claim 33 wherein step (d) comprises reducing the output current linearly when Tb is between T1 and a second reference T2, where T2 is greater than T1, and reducing the output current in a step function when Tb is equal to or greater than T2.

39. The method of claim 38 wherein step (d) further comprises increasing the output current, after Tb reaches T2, in a step function at a third reference T3 that is between T1 and T2.

40. The method of claim 33 wherein the ballast is responsive to a phase controlled AC dimming signal produced by a dimming control and the output current is controlled by at least one output switch; and wherein step (d) further comprises converting the dimming signal to a DC signal having a magnitude that varies in accordance with a duty cycle value of the dimming signal; and controlling the at least one output switch in response to the DC signal and to a feedback signal indicative of the output current.

41. The method of claim 40 wherein step (d) further comprises clamping the magnitude of the DC signal from exceeding a pre-selected upper level, and wherein the pre-selected upper level is adjusted in accordance with the difference between Tb and T1.

42. The method of claim 33 wherein step (d) comprises reducing the output current in successive step functions.

43. The method of claim 42 wherein step (b) further comprises comparing Tb to a second reference T2, greater than T1; step (c) further comprises providing an indication of the difference between Tb and T2; and step (d) comprises reducing the output current in a step function when Tb is between T1 and T2, and further reducing the output current in a step function when Tb is equal to or greater than T2.

44. The method of claim 43 further comprising the steps of:

(e) after Tb has equaled or exceeded T1, but before Tb has equaled or exceeded T2, comparing Tb to a third threshold T3, less than T1;

(f) providing an indication of the difference between Tb and T3;

(g) increasing the output current in a third step function responsive to the indication of step (f);

(h) after Tb has equaled or exceeded T2, comparing Tb to a third threshold T4, between T1 and T2;

(i) providing an indication of the difference between Tb and T4; and (j) increasing the output current in a fourth step function responsive to the indication of step (i).

45. A ballast comprising:

(a) a ballast temperature sensor providing a ballast temperature signal indicative of a ballast temperature;

(b) a foldback protection circuit receiving the ballast temperature signal and providing a foldback protection signal responsive to the ballast temperature signal;

(c) a ballast drive circuit receiving the drive signal and providing at least one switching control signal; and (d) a DC/AC back end receiving the at least one switching control signal and providing an output current to drive a lamp;

wherein the output current is responsive to the ballast temperature signal according to one of (i) a step function or (ii) a combination of step and continuous functions.

46. The ballast of claim 45 further comprising:

(e) a high end clamp receiving the foldback protection signal and providing a DC control signal to the ballast drive circuit.

47. The ballast according to claim 45 further comprising:

(e) a high end clamp providing a maximum current limiting signal indicative of a maximum current to be supplied by the ballast to the lamp; and (f) a multiplier receiving the foldback protection signal and the maximum current limiting signal and providing a DC control signal to the ballast drive circuit.

* * * * *

UNITED STATES PATENT AND TRADEMARK OFFICE

CERTIFICATE OF CORRECTION

PATENT NO. : 6,982,528 B2
DATED : January 3, 2006
INVENTOR(S) : Cottongim et al.

It is certified that error appears in the above-identified patent and that said Letters Patent is hereby corrected as shown below:

Column 3,
Line 55, delete “aback” and insert -- a back --.

Column 4,
Line 2, delete “The,” and insert -- The --.

Column 7,
Line 24, delete “of” and insert -- or --.

Column 8,
Lines 31-32, delete “non-dinning” and insert -- non-dimming --.
Line 58, delete “inventor” and insert -- invention --.
Line 67, delete “Tb,” and insert -- Tb; --.

Column 9,
Line 59, delete “TI” and insert -- T1 --.

Column 10,
Line 11, delete “claim 14” and insert -- claim 15 --.

Column 11,
Line 40, delete “switching-signal” and insert -- switching signal --.

Signed and Sealed this

Sixth Day of June, 2006

JON W. DUDAS
*Director of the United States Patent and Trademark Office*